US011577100B2

(12) United States Patent
Alqurashi et al.

(10) Patent No.: US 11,577,100 B2
(45) Date of Patent: Feb. 14, 2023

(54) OFFSHORE FACILITY EVACUATION SYSTEMS

(71) Applicant: Saudi Arabian Oil Company, Dhahran (SA)

(72) Inventors: Mahmoud Adnan Alqurashi, Dhahran (SA); Jaber Abdullah AlFayyadh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 310 days.

(21) Appl. No.: 16/878,854

(22) Filed: May 20, 2020

(65) Prior Publication Data

US 2021/0361980 A1 Nov. 25, 2021

(51) Int. Cl.
*A62B 1/20* (2006.01)
*B63C 9/22* (2006.01)
(Continued)

(52) U.S. Cl.
CPC ..... *A62B 1/20* (2013.01); *B63C 9/22* (2013.01); *B63B 35/44* (2013.01);
(Continued)

(58) Field of Classification Search
CPC .... A62B 1/00; A62B 1/20; B63C 9/00; B63C 9/22; B63C 2009/0017; B63B 35/00; B63B 35/44; B63B 2035/007; B63G 2008/004
(Continued)

(56) References Cited

U.S. PATENT DOCUMENTS 3,796,281 A 3/1974 Dowling
4,602,697 A 7/1986 Aanensen
(Continued)

FOREIGN PATENT DOCUMENTS

CN 201980398 U 9/2011
EP 2531400 B1 12/2012
(Continued)

OTHER PUBLICATIONS

International Search Report and Written Opinion for International Application No. PCT/US2021/033451, dated Sep. 28, 2021; pp. 1-15.
(Continued)

*Primary Examiner* — Lars A Olson
(74) *Attorney, Agent, or Firm* — Bracewell LLP; Constance G. Rhebergen; Brian H. Tompkins

(57) ABSTRACT

An offshore facility evacuation system that includes a submerged-floating pod (SFP) unit adapted to be positioned in a body of water adjacent an offshore facility, and a SFP station of the offshore facility adapted to launch the SFP unit from the facility. The SFP unit including a SFP controller, an SFP escape line to extend between the SFP station and the SFP unit to provide a path for moving persons from the SFP station to the SFP unit while the SFP unit is floating in the body of water, a SFP landing base including an inflatable platform to provide a landing area for persons, a SFP depth control system to regulate submergence of the SFP unit, a SFP location control system to control a location of the SFP unit, and a SFP communication system to provide communication with the SFP unit, and personal evacuation devices (PEDs).

16 Claims, 5 Drawing Sheets

(51) Int. Cl.

| | |
|---|---|
| ***B63B 35/44*** | (2006.01) |
| *B63B 35/00* | (2020.01) |
| *B63C 9/00* | (2006.01) |
| *B63G 8/00* | (2006.01) |

(52) U.S. Cl.
CPC . *B63B 2035/007* (2013.01); *B63C 2009/0017* (2013.01); *B63G 2008/004* (2013.01)

(58) Field of Classification Search
USPC ..... 182/48
See application file for complete search history.

(56) References Cited

U.S. PATENT DOCUMENTS

| | | | | |
|---|---|---|---|---|
| 4,721,412 | A | 1/1988 | King et al. | |
| 6,125,966 | A * | 10/2000 | Jones | A62B 35/0018 182/6 |
| 7,404,371 | B2 | 7/2008 | Schmitt | |
| 8,578,873 | B2 * | 11/2013 | Gasper | B63B 1/32 114/284 |
| 9,205,900 | B2 * | 12/2015 | Tatum | B63C 9/04 |
| 9,334,024 | B2 | 5/2016 | Akutsu | |
| 9,630,034 | B2 * | 4/2017 | Stewart | A62B 1/02 |
| 10,150,487 | B2 * | 12/2018 | Cylvick | A62B 1/00 |
| 10,322,783 | B2 * | 6/2019 | Valsvik | B63G 8/08 |
| 2015/0307172 | A1 | 10/2015 | Ng | |
| 2017/0327129 | A1 | 11/2017 | Cylvick | |

FOREIGN PATENT DOCUMENTS

| | | | |
|---|---|---|---|
| KR | 101540381 | B1 | 7/2015 |
| KR | 20170053791 | A | 5/2017 |
| KR | 20170082384 | A | 7/2017 |
| KR | 20180052210 | A | 5/2018 |
| WO | 199410027 | A1 | 5/1994 |
| WO | 2008054223 | A2 | 5/2008 |
| WO | 2011091854 | A1 | 8/2011 |
| WO | 2016130002 | A1 | 8/2016 |

OTHER PUBLICATIONS

Geronimo Manufacturing, Inc. "Operators Manual" (2019); available as of Feb. 18, 2020 at http://geronimomanufacturing.com/wp-content/uploads/2020/01/geronimo-owners-manual.pdf; pp. 1-26.
LiftingSafety; "Protecta "AG360/I Trollmatic" Self Regulating Inclined Plane Evaculation Descender c/w "AG300" Chair—60m or 100m" available as of Feb. 18, 2020 at https://www.liftingsafety.co.uk/product/inclined-plane-descender-2964.html; pp. 1-3.
Wikipedia; "Oil platform" available as of May 20, 2020 at: https://en.wikipedia.org/wiki/Oil_platfomn; pp. 1-14.
Wikipedia; "Zip line" available as of May 7, 2020 at: https://en.wikipedia.org/wiki/Zip_line; pp. 1-8.
Zip Line Stop; "Ultimate Torpedo Zip Line Adventure Kit with Sport-Harness" available as of May 7, 2020 at: https://www.ziplinestop.com/products/ultimate-torpedo-zip-line-adventure-kit-with-sport-harness?view=quick; pp. 1-5.

* cited by examiner

OFFSHORE FACILITY EVACUATION SYSTEMS

FIELD

Embodiments relate generally to evacuation systems and more particularly to offshore facility evacuation systems.

BACKGROUND

Offshore facilities, such as offshore oil platforms, are typically large structures that are located in bodies of water to support various offshore operations. In the context of offshore oil platforms, these typically include a large platform structures having facilities that support subsea well drilling to explore, extract, store, and process hydrocarbons (e.g., oil and gas) that reside in rock formations beneath the seabed. In many instances, a workforce resides on an offshore facility. For example, a crew of tens of persons may reside on an offshore oil platform to conduct and monitor well drilling and production operations.

In the event of an emergency occurring at offshore facility, it may be necessary to evacuate personnel from the facility. For example, in the event of a hazardous condition occurring on an offshore oil platform, such as a fire or a hazardous leak, it may be necessary to evacuate some or all of the crew from the platform. In many instances, offshore facilities include evacuation systems that can be employed to evacuate personnel from the facility. For example, an offshore oil platform may have lifeboats that can be deployed into the water to move the personnel a safe distance away from the platform.

SUMMARY

Offshore evacuation systems can be a critical and necessary component of an offshore facility. In the event of an emergency, an evacuation system can provide a route to safety for personnel that reside on the facility. For example, in the event of a hazardous condition, such as a fire or hazardous leak, an offshore facility evacuation system can provide a path for personnel to safely exit the facility. Although numerous offshore evacuation systems exists, such as lifeboats and escape capsules, many suffer from shortcomings. For example, in the case of lifeboat and capsule type evacuation systems, loading persons into a lifeboat/capsule can be a slow process that delays evacuation of persons, the lifeboats/capsules may have a fixed total capacity, each lifeboat/capsule may have to wait until it is relatively full before being dispatched, and the lowering/launching operation can be complex and potentially dangerous (especially to persons in the lifeboat/capsule).

Provided are embodiments of an offshore facility evacuation system. In some embodiments, an offshore facility evacuation system includes a submerged-floating pod (SFP) type evacuation system that includes a SFP that is operable to be launched into the water from a platform of an offshore facility. During an evacuation operation, the SFP may remain tethered to the platform by way of an escape line that provides a path for moving persons from the platform to the water. For example, once the SFP is dispatched into the water, the positioning of the SFP may be controlled to maintain tension of the escape line such that persons can descend (or "slide") down the line, from a platform of the offshore facility, to a floating platform of the SFP. In some embodiments, a SFP evacuation system includes the following: (1) a SFP station located on a platform of an offshore facility (e.g., a launching station located on a platform of an offshore oil platform); (2) a SFP unit that includes the following: (a) an escape line (e.g., a zip-line that extends from a spool located at the SFP station to the SFP unit); (b) a SFP landing base (e.g., an inflatable landing base that can be inflated once the SFP unit is dispatched in the water to provide an area for persons to land upon completing their descent along the zip-line); (c) a SFP positioning system (e.g., a position control system including a global positioning system (GPS), thrusters, pumps, and tanks configured to regulate the location and depth of the SFP unit in the water); and (d) a SFP communication system (e.g., a wireless transceiver system that is operable to provide communication between the SFP unit and the SFP station or other seagoing vessels); and (3) personal evacuation systems (PESs) (e.g., personal evacuation devices (PEDs) that each include a personal flotation device (PFD), an zip-line style evacuation harness, and a personal locating device (PLD)).

In the case of an offshore facility evacuation event, the SFP unit may be launched into the water from the SFP station (e.g., the SFP may be catapulted into the water with no persons aboard), the SFP positioning system may operate to navigate the SFP unit to a desired location (e.g., operate thrusters to move the SFP unit to a desired location), submerge the SFP to a desired depth (e.g., operate pumps to regulate a water level in an integrated tank to maintain the SFP at a desired depth), and generate and maintain tension on the escape line (e.g., operate thrusters to pull the SFP unit away from the SFP station to provide a tension on the escape line that enable persons to descend down the escape line in a zip-line fashion), and the SFP unit may deploy the landing base to provide a landing and gathering area for persons evacuating the offshore facility by way of the escape line (e.g., inflate a floating platform that is positioned at or near a distal end of the escape line to provide an area for persons to land and gather after descending down the escape line). With regard to use of such a SFP evacuation system, each person to be evacuated from the offshore facility may move to the SFP station of the facility, fit herself/himself with a PES, connect (or "hook") her/his PES to the escape line at the SFP station, jump off of the SFP station and descend along the escape line to a landing area of the landing base of the SFP (e.g., slide down the escape line in a zip-line fashion), disconnect (or "unhook") her/his PES from the escape line, and move to a gathering area of the SFP landing base (e.g., an area of the SFP landing base that is located away from the landing area) to provide an open landing area for the next person being evacuated by way of the escape line. This process may be repeated for each person evacuated.

Provided in some embodiments is an offshore facility evacuation system that includes: a SFP unit adapted to be positioned in a body of water adjacent an offshore facility; and a SFP station located on the offshore facility and adapted to launch the SFP unit from the offshore facility, the SFP unit including: a SFP controller adapted to control operations of the SFP unit; an SFP escape line adapted to extend between the SFP station and the SFP unit to provide a path for moving persons from the SFP station to the SFP unit while the SFP unit is floating in the body of water adjacent an offshore facility; a SFP landing base including an inflatable platform that is adapted to be inflated to provide a landing area for persons that move to the SFP unit by way of the SFP escape line; a SFP depth control system adapted to regulate submergence of the SFP unit in the body of water adjacent the offshore facility; a SFP location control system adapted to control a location of the SFP unit in the body of water adjacent the offshore facility; and a SFP communication system adapted to provide communication between the SFP unit and the SFP station.

In some embodiments, the SFP escape line includes a zip-line that is adapted to enable persons to descend from the offshore facility to the SFP landing base by way of sliding down the zip-line. In certain embodiments, the SFP depth control system includes: a tank; and a pump system, and the SFP controller is adapted to operate the pump system to fill or empty the tank to regulate submergence of the SFP unit. In some embodiments, the SFP controller is adapted to operate the pump system to pump water into the tank to increase submergence of the SFP unit in the body of water adjacent the offshore facility or to operate the pump system to pump water out of the tank to decrease submergence of the SFP unit in the body of water adjacent the offshore facility. In certain embodiments, the SFP location control system includes one or more thrusters adapted to direct movement of the SFP unit in the body of water adjacent the offshore facility, and the SFP controller is adapted to control operation of the thrusters to move the SFP unit to a location. In some embodiments, the SFP location control system includes one or more thrusters adapted to direct movement of the SFP unit in the body of water adjacent the offshore facility, and the SFP controller is adapted to control operation of the thrusters to generate tension on the escape line to enable a person to descend from the offshore facility to the SFP landing base by way of the escape line. In certain embodiments, the SFP station includes a rails and shuttle block, and the shuttle block is adapted to advance the SFP unit along the rails to catapult the SFP unit off of the offshore facility. In some embodiments, the system includes a personal evacuation system (PES) adapted to be worn by a person evacuating the offshore facility, the PES including: an evacuation harness including: supportive straps; a lanyard; a coupler adapted to couple to the escape line; a personal flotation device (PFD) coupled to the supportive straps; and a personal locator beacon. In certain embodiments, the offshore facility includes an offshore oil platform.

Provided in some embodiments is an offshore facility evacuation system that includes: a SFP unit adapted to be launched from an offshore facility into a body of water adjacent an offshore facility to facilitate evacuating persons from the offshore facility, the SFP unit including: a SFP controller adapted to control operations of the SFP unit; an SFP escape line adapted to extend between the SFP station and the SFP unit to provide a path for moving persons from the SFP station to the SFP unit while the SFP unit is floating in the body of water adjacent an offshore facility; a SFP landing base including an inflatable platform that is adapted to be inflated to provide a landing area for persons that move to the SFP unit by way of the SFP escape line; a SFP depth control system adapted to regulate submergence of the SFP unit in the body of water adjacent the offshore facility; a SFP location control system adapted to control a location of the SFP unit in the body of water adjacent the offshore facility; and a SFP communication system adapted to provide communication between the SFP unit and the SFP station.

In some embodiments, the SFP escape line includes a zip-line that is adapted to enable persons to descend from the offshore facility to the SFP landing base by way of sliding down the zip-line. In certain embodiments, the SFP depth control system includes: a tank; and a pump system, and the SFP controller is adapted to operate the pump system to fill or empty the tank to regulate submergence of the SFP unit. In certain embodiments, the SFP controller is adapted to operate the pump system to pump water into the tank to increase submergence of the SFP unit in the body of water adjacent the offshore facility or to operate the pump system to pump water out of the tank to decrease submergence of the SFP unit in the body of water adjacent the offshore facility. In some embodiments, the SFP location control system includes one or more thrusters adapted to direct movement of the SFP unit in the body of water adjacent the offshore facility, and the SFP controller is adapted to control operation of the thrusters to move the SFP unit to a location. In certain embodiments, the SFP location control system includes one or more thrusters adapted to direct movement of the SFP unit in the body of water adjacent the offshore facility, and the SFP controller is adapted to control operation of the thrusters to generate tension on the escape line to enable a person to descend from the offshore facility to the SFP landing base by way of the escape line. In some embodiments, the SFP station includes a rails and shuttle block, and the shuttle block is adapted to advance the SFP unit along the rails to catapult the SFP unit off of the offshore facility. In certain embodiments, the system includes a PES adapted to be worn by a person evacuating the offshore facility, the PES including: an evacuation harness including: supportive straps; a lanyard; a coupler adapted to couple to the escape line; a personal flotation device (PFD) coupled to the supportive straps; and a personal locator beacon. In some embodiments, the offshore facility includes an offshore oil platform.

Provided in some embodiments is a PES adapted to be worn by a person evacuating an offshore facility by way of an escape line, the PES including: an evacuation harness including: supportive straps; a lanyard; a coupler adapted to couple to the escape line; a personal flotation device (PFD) coupled to the evacuation harness; and a personal locator device (PLD) coupled to the evacuation harness. In some embodiments, the coupler is adapted to couple a trolley coupled to the escape line. In certain embodiments, the PFD includes a life vest coupled to the supportive straps and the PLD includes a locator beacon coupled to the life vest.

Figure 1A:
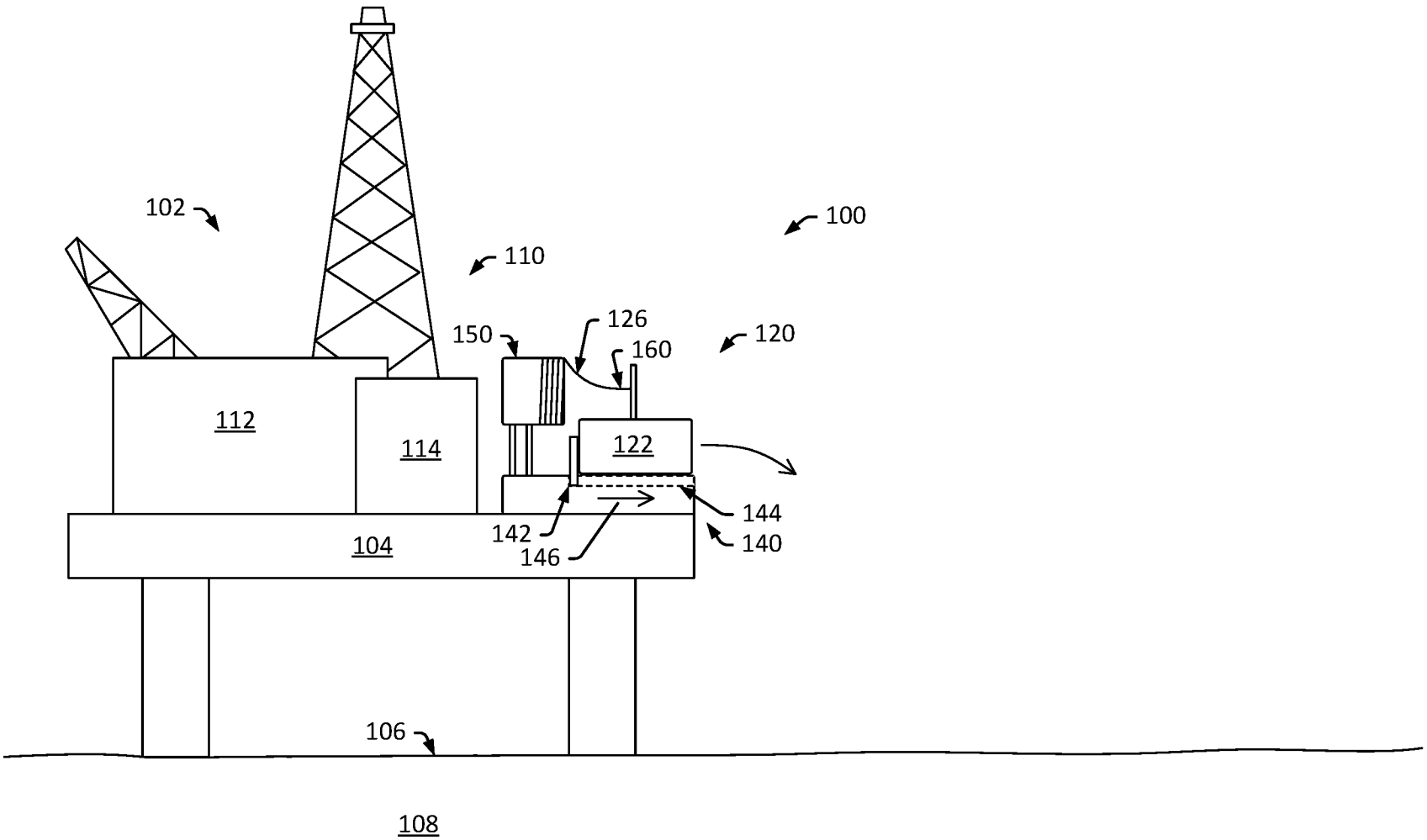
FIGS. 1A and 1B are diagrams that illustrate an offshore environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and methods for offshore facility evacuation. In some embodiments, an offshore facility evacuation system includes a submerged-floating pod (SFP) type evacuation system that includes a SFP that is operable to be launched into the water from a platform of an offshore facility. During an evacuation operation, the SFP may remain tethered to the platform by way of an escape line that provides a path for moving persons from the platform to the water. For example, once the SFP is dispatched into the water, the positioning of the SFP may be controlled to maintain tension of the escape line such that persons can descend (or "slide") down the line, from a platform of the offshore facility, to a floating platform of the SFP. In some embodiments, a SFP evacuation system includes the following: (1) a SFP station located on a platform of an offshore facility (e.g., a launching station located on a platform of an offshore oil platform); (2) a SFP unit that includes the following: (a) an escape line (e.g., a zip-line that extends from a spool located at the SFP station to the SFP unit); (b) a SFP landing base (e.g., an inflatable landing base that can be inflated once the SFP unit is dispatched in the water to provide an area for persons to land upon completing their descent along the zip-line); (c) a SFP positioning system (e.g., a position control system including a global positioning system (GPS), thrusters, pumps, and tanks configured to regulate the location and depth of the SFP unit in the water); and (d) a SFP communication system (e.g., a wireless transceiver system that is operable to provide communication between the SFP unit and the SFP station or other seagoing vessels); and (3) personal evacuation systems (PESs) (e.g., personal evacuation devices (PEDs) that each include a personal flotation device (PFD), an zip-line style evacuation harness, and a personal locating device (PLD)).

In the case of an offshore facility evacuation event, the SFP unit may be launched into the water from the SFP station (e.g., the SFP may be catapulted into the water with no persons aboard), the SFP positioning system may operate to navigate the SFP unit to a desired location (e.g., operate thrusters to move the SFP unit to a desired location), submerge the SFP to a desired depth (e.g., operate pumps to regulate a water level in an integrated tank to maintain the SFP at a desired depth), and generate and maintain tension on the escape line (e.g., operate thrusters to pull the SFP unit away from the SFP station to provide a tension on the escape line that enable persons to descend down the escape line in a zip-line fashion), and the SFP unit may deploy the landing base to provide a landing and gathering area for persons evacuating the offshore facility by way of the escape line (e.g., inflate a floating platform that is positioned at or near a distal end of the escape line to provide an area for persons to land and gather after descending down the escape line). With regard to use of such a SFP evacuation system, each person to be evacuated from the offshore facility may move to the SFP station of the facility, fit herself/himself with a PES, connect (or "hook") her/his PES to the escape line at the SFP station, jump off of the SFP station and descend along the escape line to a landing area of the landing base of the SFP (e.g., slide down the escape line in a zip-line fashion), disconnect (or "unhook") her/his PES from the escape line, and move to a gathering area of the SFP landing base (e.g., an area of the SFP landing base that is located away from the landing area) to provide an open landing area for the next person being evacuated by way of the escape line. This process may be repeated for each person evacuated.

Although certain embodiments are described in the context of an oil platform type offshore facility for the purpose of illustration, embodiments may be employed for other types of facilities, such as floating production, storage and offloading (FPSO) systems, ships, barges and other water based facilities.

Figure 1B:
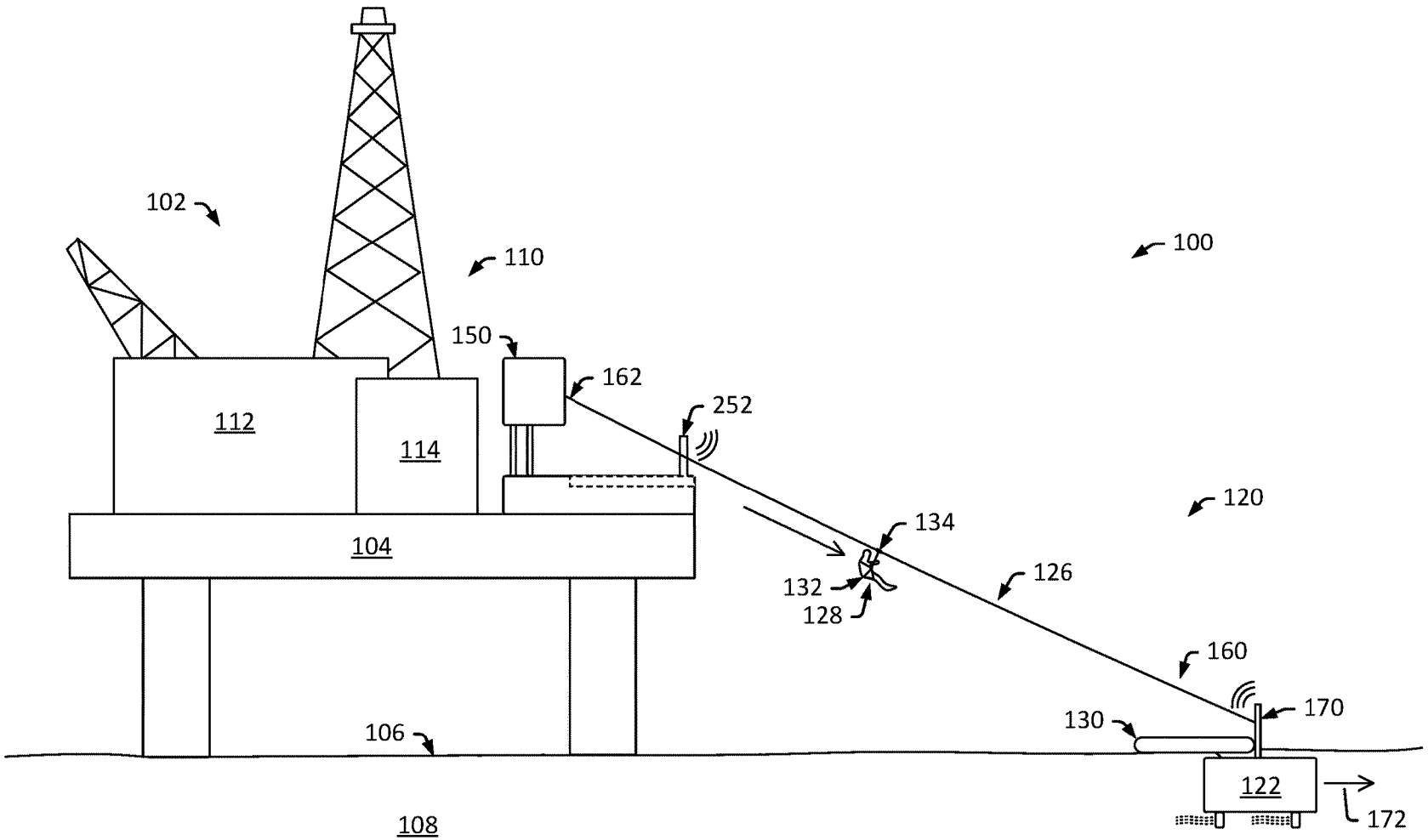

FIGS. 1A and 1B are diagrams that illustrate an offshore environment ("environment") 100 in accordance with one or more embodiments. In the illustrated embodiment, the environment 100 includes an oil platform type offshore facility (or "oil platform") 102 that includes a platform structure 104 supported above a waterline 106 of a body of water (or "water") 108. The platform structure includes operational facilities 110, such as oil drilling equipment 112, living quarters 114, and a submerged-floating pod (SFP) type offshore facility evacuation system (or "SFP evacuation system") 120.

In some embodiments, the SFP evacuation system 120 includes a submerged-floating pod (SFP) unit 122 and a submerged-floating pod (SFP) station 124. The SFP unit 122 may be operable to navigate away from the oil platform 102 to generate and maintain a tension on an escape line 126 that is sufficient to support personnel 128 descending down the escape line 126 (e.g., in a zip-line fashion), from the oil platform 102, to the safety of a floating landing base 130 of the SFP unit 122 located at the waterline 106.

In some embodiments, the SFP station 124 includes a SFP launching system 140 that is operable to launch the SFP unit 122 into the water 108. For example, the SFP launching system 140 may include a catapult type device that includes a shuttle block 142 and rails 144. In such an embodiment, the shuttle block 142 may be advanced (in the direction of arrow 146) to catapult the SFP unit 122 along (and off of) the rails 144. This may drive the SFP unit 122 off of the oil platform 102 and into a gravity driven free fall into the body of water 108.

In some embodiments, the SFP station 124 includes a spool 150 that houses a length of the escape line 126. For example, the spool 150 may include a cylindrical member having a length (e.g., 100 meters (m)) of the escape line 126 coiled thereabout, with a distal end 160 of the escape line 126 tethered to the SFP unit 122 and a proximal end 162 of the escape line 126 tethered to the spool 150. In such an embodiment, as the SFP unit 122 is catapulted away from the SFP station 124, the escape line 126 may be uncoiled from the spool 150 as its distal end 160 is pulled away from the spool 150 by movement of the SFP unit 122 away from the SFP station 124 (see, e.g., FIG. 1B). Once fully deployed from the spool 150, the escape line 126 may span between the connection of its proximal end 162 to the spool 150 and the connection of its distal end 160 to a mast 170 the SFP unit 122. As described, in some embodiments, the SFP unit 122 is operable to navigate away from the oil platform 102 (as indicated by arrow 172) to create and maintain a tension on the escape line 126 that is sufficient to support personnel 128 descending down the escape line 126 (e.g., in a zip-line fashion), from the SFP station 124 of the oil platform 102, to the safety of a floating landing base 130 of the SFP unit 122 located at the waterline 106.

In some embodiments, evacuation of a person 128 includes the person fitting themselves with a personal evacuation system (PES) 132 that includes an evacuation harness (e.g., a zip-line harness), a personal flotation device (PFD) (e.g., a life vest), and a personal locating device (PLD) (e.g., a personal locator beacon), coupling the PES 132 to the escape line 126 (e.g., by way of a carbineer clipped to a trolley 134 that slides along the escape line 126), the person jumping from the SFP station 124 and descending down the escape line (e.g., in a zip-line fashion) to a landing area of the floating landing base 130 of the SFP unit 122 below, decoupling the PES 132 from the escape line 126, and moving to a gathering area of the floating landing base 130. This may repeated for each person 128 evacuating the oil platform 102 by way of the SFP station 124. In some embodiments, the oil platform 102 includes multiple SFP stations 124 and corresponding SFP units 122 that can be employed in parallel to evacuate persons from the oil platform 102.

Figure 2A:
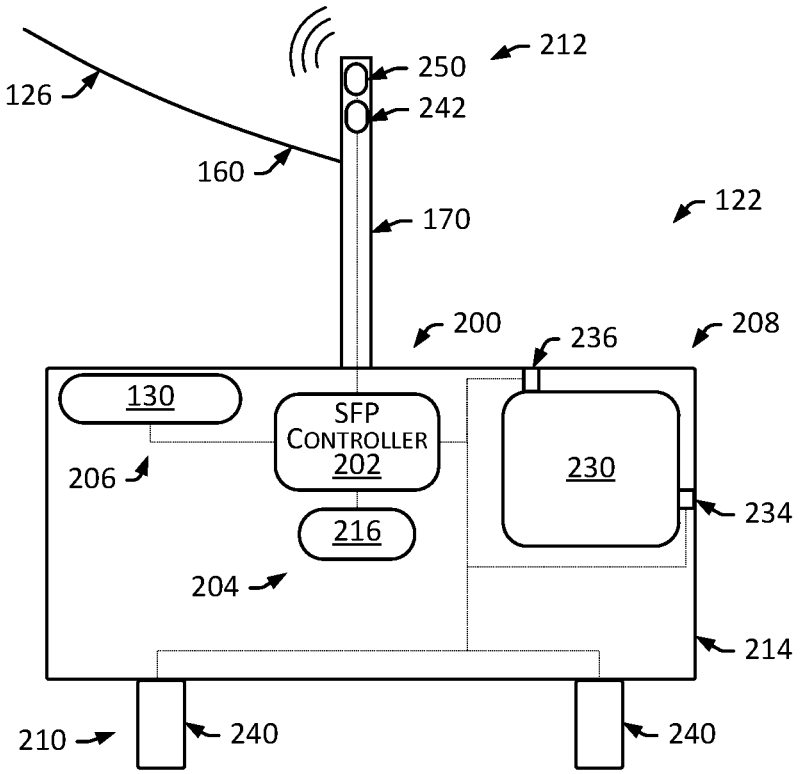
FIGS. 2A and 2B are diagrams that illustrate a submerged-floating pod (SFP) evacuation system in accordance with one or more embodiments.
Figure 2B:
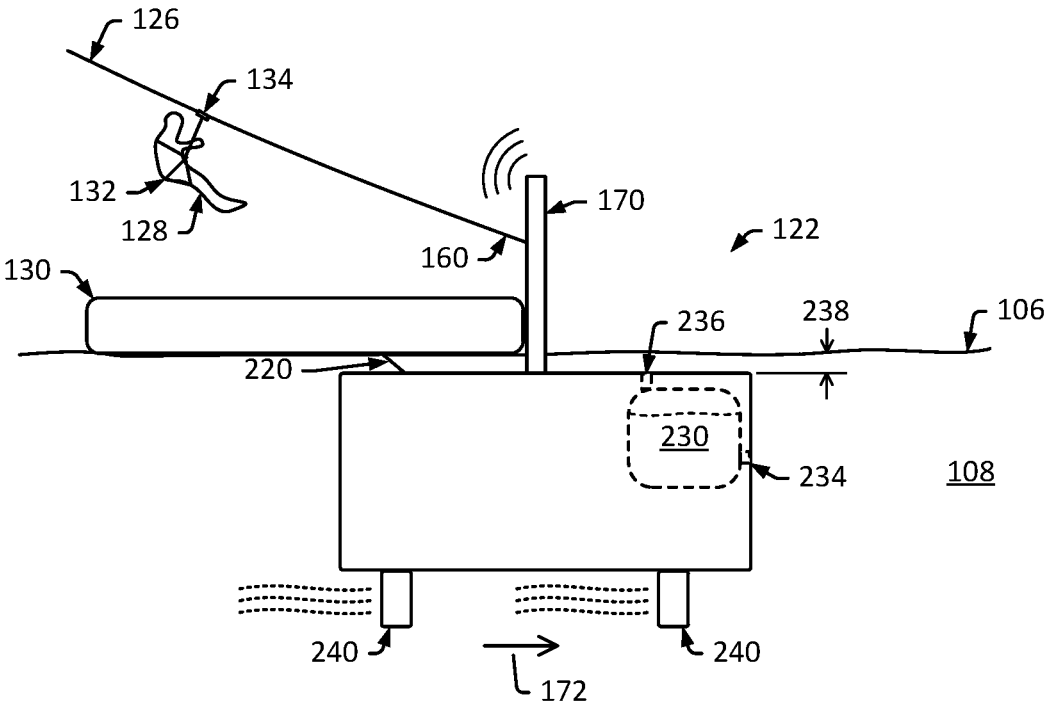

FIGS. 2A and 2B are diagrams that illustrate a SFP unit 122 in accordance with one or more embodiments. FIG. 2A illustrates various operational components of the SFP unit 122 and FIG. 2B illustrates operation of the SFP unit 122 in a deployed configuration. Referring to FIG. 2A, in some embodiments, the SFP unit 122 includes a SFP unit control system 200 that includes a SFP controller 202, a SFP power system 204, a SFP landing base system 206, a SFP depth control system 208, a SFP location control system 210, and a SFP communication system 212. Each of the systems may be coupled to or contained within a SFP housing 214 to provide a unitary system that integrates the various functions provided by the respective systems. The SFP housing 214 may be, for example, a metal or plastics housing that encloses some or all of the environment sensitive components of the various systems to shield them for offshore conditions, including moisture, salt or extreme temperatures.

In some embodiments, the SFP controller 202 is operable to monitor and control operations of the various systems of the SFP unit control system 200. For example, the SFP controller 202 may monitor and control the SFP power system 204 to ensure that electrical power is appropriately routed to each of the other systems to support their respective operations, monitor and control the SFP landing base system 206 to ensure that the landing base 130 is appropriately deployed and positioned, monitor and control the SFP depth control system 208 to ensure that the SFP unit 122 is maintained at an appropriate depth (or "level of submergence") within the body of water 108, monitor and control the SFP location control system 210 to navigate the SFP unit 122 to a desired location in the water 108 and to maintain a sufficient tension on the escape line 126, or monitor and control the SFP communication system 212 to support communications with the SFP station 124 or other seagoing vessels. In some embodiments, the SFP controller 202 is a computer system that is the same or similar to the computer system 1000 illustrated and described with regard to at least FIG. 4.

In some embodiments, the SFP power system 204 includes a local power supply 216 that is capable of supplying some or all of the power required to operate the various components of the SFP unit 122. For example, the SFP power system 204 may include an on board battery that is capable of storing and supplying electrical power for operating the various components of the SFP unit 122. In some embodiments, the SFP power system 204 includes a supplemental power source. For example, the SFP power system 204 may include a generator or a solar panel. In such an embodiment, the supplemental power source (e.g., the generator or the solar panel) may be operable to generate electrical power that is used to power one or more of the various components of the SFP unit 122 or to recharge a battery of the SFP power system 204. The SFP controller 202 may, for example, control routing of power between the source(s), the battery and the various components of the SFP unit 122.

In some embodiments, the SFP landing base system 206 includes a landing base 130 that provides an area for persons to land and gather upon completing the descent along the escape line 126. For example, SFP landing base system 206 may include an inflatable landing base 130 that can be deployed and inflated to provide a platform that persons can land on upon completing their descent along the escape line 126. The inflatable landing base 130 may, for example, include an inflatable rubber raft that is tethered to the SFP unit housing 214 by way of a landing base tether 220 (see, e.g., FIG. 2B). In such an embodiment, the inflatable landing base 130 may be stored in a deflated configuration and be inflated with its landing base tether 220 coupled to the SFP unit housing 214. For example, in response to the SFP controller 202 determining that the SFP unit 122 has navigated into a desired position within the body of water 108 (e.g., the SFP unit 122 has navigated to a desired location away from the oil platform 102 and has reached a desired level of submergence relative to the waterline 106), the SFP controller 202 may control the SFP landing base system 206 to deploy the inflatable landing base 130. This may include inflating the inflatable landing base 130 such that is floats at the waterline 106, where it is retained by the landing base tether 220 (see, e.g., FIG. 2B).

In some embodiments, the SFP depth control system (or "SFP submergence control system") 208 includes a tank 230 that can be filled of emptied of water or air control a level of submergence of the SFP unit 122. For example, the SFP depth control system 208 may include a tank 230 and a pump system 232 that is operable to regulate an amount of water present in the tank 230 to regulate the level of submergence of the SFP unit 122. The pump system 232 may include a pump 234 that is operable to pump water 108 into or out of the tank type vessel 230 and an air valve 236 that is operable to regulate the flow of air and water 108 into or out of the tank 230. In such an embodiment, the tank type vessel 230 may be filled with water to increase the level of submergence of the SFP unit 122, or the tank type vessel 230 may be emptied of water (or be filled with air) to decrease the level of submergence of the SFP unit 122. For example, in response to the SFP controller 202 determining that the SFP unit 122 is not sufficiently submerged (e.g., a top surface of the housing 214 is not at least a given distance below the waterline 106), the SFP controller 202 may control the SFP depth control system 208 to open the air valve 236 and to operate the pump 234 to pump water 108 into the tank 230. In response to the SFP controller 202 determining that the SFP unit 122 is overly submerged (e.g., the top surface of the housing 214 is too far below the waterline 106), the SFP controller 202 may control the SFP depth control system 208 to open the air valve 236 and operate the pump 234 to pump water 108 from the tank 230. In response to the SFP controller 202 determining that the SFP unit 122 is appropriately submerged (e.g., the top surface of the housing 214 is at an acceptable depth below the waterline 106), the SFP controller 202 may control SFP depth control system 208 to close the air valve 236 and stop operation of the pump 234 to inhibit water 108 from entering or exiting the tank 230.

In some embodiments, the level of submergence of the SFP unit 122 may be defined by a distance 238 between a top surface of the housing 214 and the waterline 106 of the body of water 108 (see, e.g., FIG. 2B). In some embodiments, a desired/appropriate level of submergence may be defined by a corresponding range of depths (e.g., 1-2 meters (m)). Submergence of the SFP unit 122 to a desired/appropriate level may reduce the impact of undulations at the waterline 106 on the positioning of the SFP unit 122. Submergence of the SFP unit 122 increase the safety of the landing area. For example, the submergence of the SFP unit may provide a layer of water 108 above a top surface of the housing 214 of the SFP unit 122 which can inhibit direct impacts of persons with the housing 214 upon their decent to, and arrival at, the SFP unit 122.

In some embodiments, the SFP location control system (or "SFP steering control system") 210 includes one or more thrusters 240 and a global positioning system (GPS) 242 that are operable to control navigation of the SFP unit 122. For example, the SFP location control system 210 may include one or more steerable thrusters 240 that can be operated to propel and steer the SFP unit 122 in the body of water 108 based on location, direction and velocity information obtained by way of the GPS 242. In such an embodiment, the one or more steerable thrusters 240 may be operated to move the SFP unit 122 to a desirable location (e.g., to predetermined latitude and longitude) and to generate a sufficient level and direction of thrust to generate and maintain a desired level of tension on the escape line 126. The desired level of tension may enable the escape line 126 to support personnel 128 descending down the escape line 126 (e.g., in a "zip-line" fashion). This may include maintaining the escape line 126 at angle of about 30 degrees (e.g., 25-35 degrees) relative to the waterline 106. For example, in response to the SFP controller 202 determining that the SFP unit 122 has entered the body of water 106 (e.g., after the SFP unit 122 has been catapulted from the SFP station 124), the SFP controller 202 may control the one or more steerable thrusters 240 to navigate the SFP unit 122 into a desired position (e.g., to a predetermined latitude and longitude that is approximately twice as far away from the SFP station 122 (horizontally) as the SFP station 124 is above the waterline 106 (vertically) and to generate a sufficient thrust to pull the SFP unit 122 away from the SFP station 124 (e.g., at predetermined heading/trajectory directed away from the SFP station 124) to generate and maintain a level of tension on the escape line 126 to maintain the escape line 126 at an angle of about 30 degrees (e.g., 25-35 degrees) relative to the waterline 106, which should enable personnel 128 to descend down the escape line 126 (e.g., in a zip-line fashion). In some embodiments, the thrusters are operated based on location, direction and velocity information provided by the GPS 242. The GPS 242 may include, for example, a GPS antenna located at an upper end of a mast 170 that extends upward from the housing 214 of the SFP unit 122.

In some embodiments, the SFP communication system 212 includes a wireless radio transceiver 250 that is operable to provide communication between the SFP 122 and the SFP station 124. For example, the SFP communication system 212 may include a wireless radio transceiver 250 that is operable to communicate with a complementary wireless radio transceiver 252 (see, e.g., FIG. 1B) located at the SFP station 124. This may enable persons located at the SPF unit 122 to communicate with persons located at or near the SFP station 124. For example, as a person completes her/his descent down the escape line 126, reaches the landing area of the inflatable base 130, detaches her/his PES 132 from the escape line 126, and moves away from the landing area of the inflatable base 130 and to a gathering area of the inflatable base 130, a person at the SPF unit 122 may send a communication (or "radio") to the SFP station 124, by way of the radio transceiver 250 and the complementary wireless radio transceiver 252 located at the SFP station 124, an "all clear and ready" message to indicate that the next person to be evacuated can begin her/his descent down the escape line 126 to the SFP unit 122. In some embodiments, the SFP communication system 212 is operable to provide communication between the SFP 122 and other seagoing vessels. For example, the wireless radio transceiver 250 may be tuned to a radio frequency that enables communication with other seagoing vessels having a radio operating on a corresponding radio frequency. Thus, the SFP communication system 212 may enhance safety by enabling person to communicate directly with persons at the SFP station 124 or other locations.

In some embodiments, the SFP communication system 212 is operable to communicate system status information to the SFP station 124. For example, the SFP controller 202 may transmit, to the SFP station 124 status information indicating an operational status of the various systems of the SFP unit 122. This may enable evacuation personnel at the SFP station 124 to assess operations of the SFP unit 122 prior to evacuating persons 128 to the SFP unit 122. For example, if the SFP controller 202 sends a communication indicating that all systems and operations of the SFP unit 122 are satisfactory, evacuation personnel may continue to evacuate persons 128 to the SFP unit 122 by way of the escape line 126. If the SFP controller 202 sends a communication indicating that the landing base 130 is not inflated, that the SFP unit 122 is not appropriately submerged, or the SFP location control system 210 is not operational, evacuation personnel may refrain from evacuating persons 128 to the SFP unit 122 by way of the escape line 126. In some embodiments, the wireless radio transceiver 250 includes a radio antenna located at an upper end of the mast 170 of the SFP unit 122.

Figure 3:
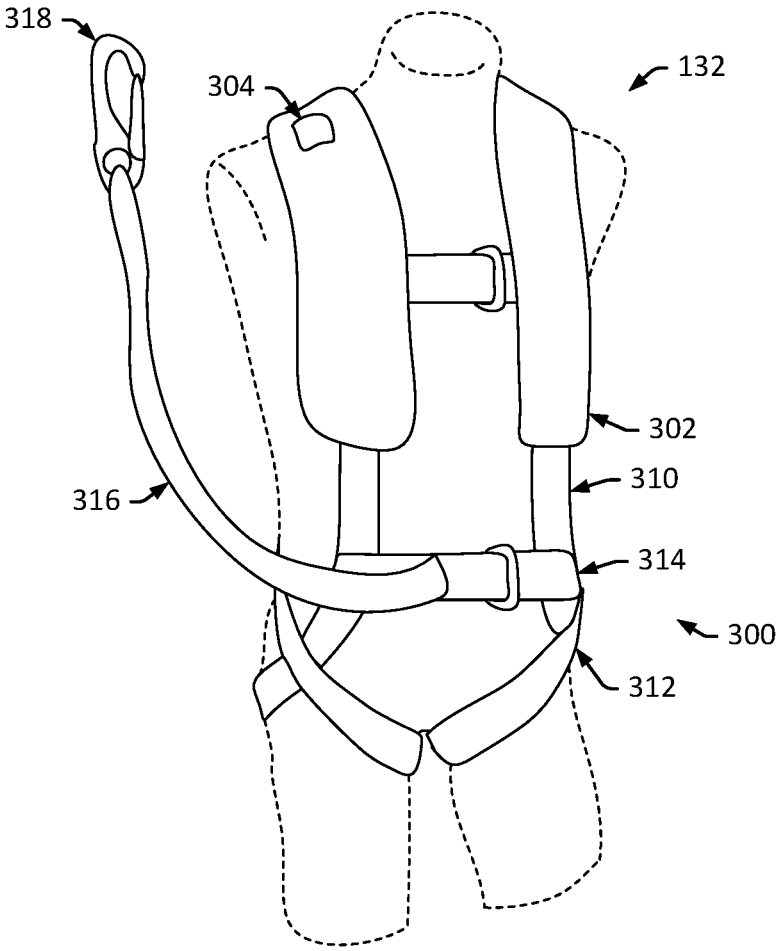
FIG. 3 is a diagram that illustrates a personal evacuation system (PES) in accordance with one or more embodiments.

FIG. 3 is a diagram that illustrates a personal evacuation system (PES) 132 in accordance with one or more embodiments. In some embodiments, the PES 132 includes an evacuation harness 300, a personal flotation device (PFD) 302 and a personal locator device (PLD) 304. Each PES 132 may be operable to support a person 128 descending down the escape line 126, provide flotation for the person 128 in the water 108, or provide for locating the person 128. In some embodiments, the evacuation harness 300 includes a zip-line style harness that is operable to support a person descending down a zip-line. For example, the evacuation harness 300 may include supportive straps, such as torso straps 310, leg straps 312, and a waist strap 314, a lanyard 316 and an escape line coupler (e.g., a carabiner) 318. During use, the torso straps 310, leg straps 312, and waist strap 314 may be fitted about the torso, legs and waist, respectively, of a person 128, and the escape line coupler 318 may be attached to (and detached from) a complementary hole of a trolley 134 attached to the escape line 126. In some embodiments, the PFD 302 includes a life vest that is operable to provide floatation of the person in the event the person is submerged in water. For example, the PFD 302 may include an inflatable bladder or foam type life vest that is coupled to the torso straps 310 of the evacuation harness 300. In some embodiments, the PLD 304 includes a personal locator beacon (PLB) that is operable to transmit information regarding the location of the PES 132 (and a person 128 wearing the PES 132) to third parties. Such integration of the various components of the PES 132 may simplify and speed-up evacuation procedures by requiring a person 128 to fit themselves with only a single device as opposed to gathering and assembling the various components individually.

During non-evacuation conditions, such as during day-to-day operations of the oil platform 102, the SFP unit 122 and PESs 132 may remain stationed at the SFP station 124. During evacuation conditions (e.g., in the event of a fire or a hazardous leak that presents a risk to persons 128 residing on the platform of the oil platform 102), a controller of the SFP station 124 may initiate a launching operation that includes advancing the shuttle block 142 (in the direction of arrow 146) to catapult the SFP unit 122 along (and off of) the rails 144 such that the SFP unit 122 is driven off of the oil platform 102 and into a gravity driven free fall into the body of water 108. As the SFP unit 122 is catapulted away from the SFP station 124, the escape line 126 may unspool from the spool 150 as its distal end 160 is pulled away from the spool 150 by movement of the SFP unit 122. In response to the SFP controller 202 determining that the SFP unit 122 has reached the body of water 108, the SFP controller 202 may operate the thrusters 240 the SFP location control system 210 to navigate the SFP unit 122 to a location (e.g., to a specified latitude and longitude) away from the oil platform 102, and operate the pump 234 and air valve 236 of the SFP depth control system 208 to submerge the SFP unit 122 to a desired level of submergence (e.g., to a depth 238 of about 1-2 m). In response to the SFP controller 202 determining that the SFP unit 122 has navigated to the desired position (e.g., including the desired location and level of submergence), the SFP controller 202 may control the SFP landing base system 206 to deploy the inflatable landing base 130 such that it is inflated and floats at the waterline 106, where it is retained by the landing base tether 220. In response to the SFP controller 202 determining that the inflatable landing base 130 has been properly deployed and that the SFP unit 122 remains in the desired position, the SFP controller 202 may operate the thrusters 240 to generate a sufficient force to pull the SFP unit 122 away from the SFP station 124 (e.g., at predetermined heading/trajectory directed away from the SFP station 124) to generate and maintain a level of tension on the escape line 126 to maintain the escape line 126 at an angle of about 30 degrees (e.g., 25-35 degrees) relative to the waterline 106, which should enable personnel 128 to descend down the escape line 126 (e.g., in a zip-line fashion). In response to the SFP controller 202 determining that the SFP unit 122 is at or near the desired positon (e.g., within about 10 meters of the desired positon), the inflatable landing base 130 has been properly deployed, and a sufficient level of tension is maintained on the escape line 126, the SFP controller 202 may send an "all clear and ready" message to the SFP station 124 (e.g., by way of the radio transceiver 250 of the SFP communication system 122). The message may indicate that the next person to be evacuated can begin her/his descent down the escape line 126 to the SFP unit 122. At or before this point in time, one or more persons 128 may fit themselves with a PES 132 and move to a "jump-off" point of the SFP station 124. In response to receiving the "all clear and ready" message, a first of the persons 128 may connect the escape line coupler 318 of her/his PES 132 to a trolley 134 fitted to the escape line 126, and the person may jump from the "jump-off" point of the SFP station 124 such that she/he descends down the escape line 126 (e.g., in a zip-line fashion) to the landing area of the inflatable landing base 130. Upon reaching the landing area of the inflatable landing base 130, the person 128 may disconnect the escape line coupler 318 of her/his PES 132 from the trolley 134 and move to a gathering area of the landing base 130. In response to the person 128 moving away from the landing area of the inflatable landing base 130, a next "all clear and ready" message may be communicated to the SFP station 124 (e.g., by way of the radio transceiver 250 or hand signals). In response to receipt of the "all clear and ready" message at the SFP station 124, a next person 128 may evacuate the oil platform 102 by way of the escape line 126 in a similar manner as the first person 128. This evacuation procedure may be repeated for each person 128 evacuating by way of the SFP evacuation system 120.

Figure 4:
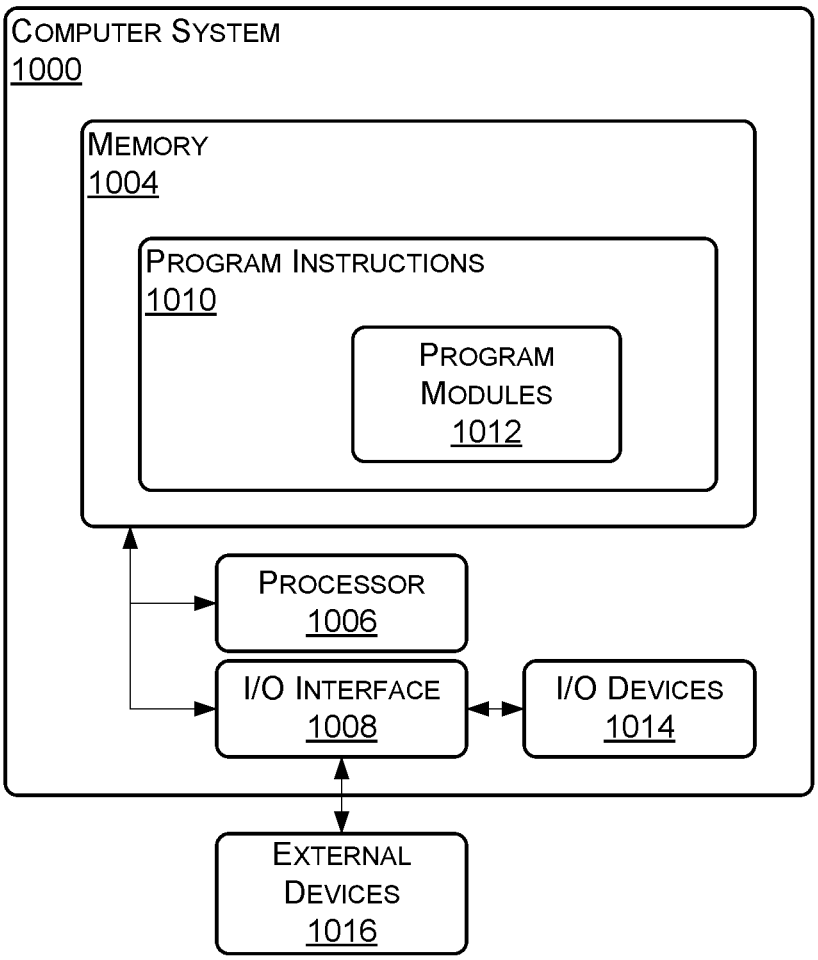
FIG. 4 is a diagram that illustrates an example computer system in accordance with one or more embodiments.

FIG. 4 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (e.g., flash memory, read-only memory (ROM), programmable read-only memory (PROM), erasable programmable read-only memory (EPROM), electrically erasable programmable read-only memory (EEPROM)), volatile memory (e.g., random access memory (RAM), static random access memory (SRAM), synchronous dynamic RAM (SDRAM)), or bulk storage memory (e.g., CD-ROM or DVD-ROM, hard drives). The memory 1004 may include a non-transitory computer-readable storage medium having program instructions 1010 stored thereon. The program instructions 1010 may include program modules 1012 that are executable by a computer processor (e.g., the processor 1006) to cause the functional operations described, such as those described with regard to the SFP controller 202 or the SFP station 124.

The processor 1006 may be any suitable processor capable of executing program instructions. The processor 1006 may include a central processing unit (CPU) that carries out program instructions (e.g., the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (e.g., an electronic display for displaying a graphical user interface (GUI)). The I/O devices 1014 may include one or more of the user input devices. The I/O devices 1014 may be connected to the I/O interface 1008 by way of a wired connection (e.g., an Industrial Ethernet connection) or a wireless connection (e.g., a Wi-Fi connection). The I/O interface 1008 may provide an interface for communication with one or more external devices 1016. In some embodiments, the I/O interface 1008 includes one or both of an antenna and a transceiver. In some embodiments, the external devices 1016 include other components, such as those of the SFP power system 204, the SFP landing base system 206, the SFP depth control system 208, the SFP location control system 210, the SFP communication system 212, of the SFP station 124.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (e.g., by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. An offshore facility evacuation system comprising:

a submerged-floating pod (SFP) unit configured to be positioned in a body of water adjacent an offshore facility; and a SFP station located on the offshore facility and configured to launch the SFP unit from the offshore facility, wherein the SFP station comprises a rails and shuttle block, wherein the shuttle block is configured to advance the SFP unit along the rails to catapult the SFP unit off of the offshore facility, the SFP unit comprising:

a SFP controller configured to control operations of the SFP unit;

an SFP escape line configured to extend between the SFP station and the SFP unit to provide a path for moving persons from the SFP station to the SFP unit while the SFP unit is floating in the body of water adjacent an offshore facility;

a SFP landing base comprising an inflatable platform that is configured to be inflated to provide a landing area for persons that move to the SFP unit by way of the SFP escape line;

a SFP depth control system configured to regulate submergence of the SFP unit relative to the waterline in the body of water adjacent the offshore facility, wherein the submergence is determined based on a top surface of a housing of the SFP unit and a distance below the waterline;

a SFP location control system configured to control a location of the SFP unit in the body of water adjacent the offshore facility; and a SFP communication system configured to provide communication between the SFP unit and the SFP station.

2. The system of claim 1, wherein the SFP escape line comprises a zip-line that is configured to enable persons to descend from the offshore facility to the SFP landing base by way of sliding down the zip-line.

3. The system of claim 1, wherein the SFP depth control system comprises:

a tank; and a pump system, wherein the SFP controller is configured to operate the pump system to fill or empty the tank to regulate submergence of the SFP unit.

4. The system of claim 3, wherein the SFP controller is configured to operate the pump system to pump water into the tank to increase submergence of the SFP unit in the body of water adjacent the offshore facility or to operate the pump system to pump water out of the tank to decrease submergence of the SFP unit in the body of water adjacent the offshore facility.

5. The system of claim 1, wherein the SFP location control system comprises one or more thrusters configured to direct movement of the SFP unit in the body of water adjacent the offshore facility, and wherein the SFP controller is configured to control operation of the thrusters to move the SFP unit to a location.

6. The system of claim 1, wherein the SFP location control system comprises one or more thrusters configured to direct movement of the SFP unit in the body of water adjacent the offshore facility, and wherein the SFP controller is configured to control operation of the thrusters to generate tension on the escape line to enable a person to descend from the offshore facility to the SFP landing base by way of the escape line.

7. The system of claim 1, further comprising a personal evacuation system (PES) configured to be worn by a person evacuating the offshore facility, the PES comprising:

an evacuation harness comprising:

supportive straps;

a lanyard;

a coupler configured to couple to the escape line;

a personal flotation device (PFD) coupled to the supportive straps; and a personal locator beacon.

8. The system of claim 1, wherein the offshore facility comprises an offshore oil platform.

9. An offshore facility evacuation system comprising:

a submerged-floating pod (SFP) unit configured to be launched from an offshore facility into a body of water adjacent an offshore facility to facilitate evacuating persons from the offshore facility, the SFP unit comprising:

a SFP controller configured to control operations of the SFP unit;

an SFP escape line configured to extend between an SFP station and the SFP unit to provide a path for moving persons from the SFP station to the SFP unit while the SFP unit is floating in the body of water adjacent an offshore facility, wherein the SFP station comprises a rails and shuttle block, wherein the shuttle block is configured to advance the SFP unit along the rails to catapult the SFP unit off of the offshore facility;

a SFP landing base comprising an inflatable platform that is configured to be inflated to provide a landing area for persons that move to the SFP unit by way of the SFP escape line;

a SFP depth control system configured to regulate submergence of the SFP unit relative to the waterline in the body of water adjacent the offshore facility, wherein the submergence is determined based on a top surface of a housing of the SFP unit and a distance below the waterline;

a SFP location control system configured to control a location of the SFP unit in the body of water adjacent the offshore facility; and a SFP communication system configured to provide communication between the SFP unit and the SFP station.

10. The system of claim 9, wherein the SFP escape line comprises a zip-line that is configured to enable persons to descend from the offshore facility to the SFP landing base by way of sliding down the zip-line.

11. The system of claim 9, wherein the SFP depth control system comprises:

a tank; and a pump system, wherein the SFP controller is configured to operate the pump system to fill or empty the tank to regulate submergence of the SFP unit.

12. The system of claim 11, wherein the SFP controller is configured to operate the pump system to pump water into the tank to increase submergence of the SFP unit in the body of water adjacent the offshore facility or to operate the pump system to pump water out of the tank to decrease submergence of the SFP unit in the body of water adjacent the offshore facility.

13. The system of claim 9, wherein the SFP location control system comprises one or more thrusters configured to direct movement of the SFP unit in the body of water adjacent the offshore facility, and wherein the SFP controller is configured to control operation of the thrusters to move the SFP unit to a location.

14. The system of claim 9, wherein the SFP location control system comprises one or more thrusters configured to direct movement of the SFP unit in the body of water adjacent the offshore facility, and wherein the SFP controller is configured to control operation of the thrusters to generate tension on the escape line to enable a person to descend from the offshore facility to the SFP landing base by way of the escape line.

15. The system of claim 9, further comprising a personal evacuation system (PES) configured to be worn by a person evacuating the offshore facility, the PES comprising:

an evacuation harness comprising:

supportive straps;

a lanyard;

a coupler configured to couple to the escape line;

a personal flotation device (PFD) coupled to the supportive straps; and a personal locator beacon.

16. The system of claim 9, wherein the offshore facility comprises an offshore oil platform.

* * * * *